US005741414A

United States Patent [19]

Waku et al.

[11] Patent Number: 5,741,414

[45] Date of Patent: Apr. 21, 1998

[54] METHOD OF MANUFACTURING GAS OIL CONTAINING LOW AMOUNTS OF SULFUR AND AROMATIC COMPOUNDS

[75] Inventors: Toshio Waku; Masanari Akiyama, both of Yokohama, Japan

[73] Assignee: Nippon Oil Co., Ltd., Japan

[21] Appl. No.: 522,973

[22] Filed: Sep. 1, 1995

[30] Foreign Application Priority Data

Sep. 2, 1994 [JP] Japan ..... 6-234206

[51] Int. Cl.[6] ..... C10G 69/02

[52] U.S. Cl. ..... 208/89; 208/94; 208/143; 208/144; 208/210; 208/212; 585/264; 585/265

[58] Field of Search ..... 208/89, 94, 143, 208/144, 212, 210; 585/265, 264

[56] References Cited

U.S. PATENT DOCUMENTS

| | | | |
|---|---|---|---|
| 2,948,674 | 8/1960 | Eldib et al. | 208/210 |
| 3,236,764 | 2/1966 | Den Herder et al. | 208/210 |
| 3,347,779 | 10/1967 | Groenendall et al. | 208/89 |
| 3,369,998 | 2/1968 | Bercik et al. | 208/210 |
| 3,392,112 | 7/1968 | Bercik et al. | 208/210 |
| 3,429,801 | 2/1969 | Gleim et al. | 208/210 |
| 3,484,496 | 12/1969 | Carruthers et al. | 208/89 |
| 3,519,557 | 7/1970 | Pruiss | 208/210 |
| 3,573,198 | 3/1971 | Parker et al. | 208/89 |
| 3,594,307 | 7/1971 | Kirk, Jr. | 208/210 |
| 3,654,139 | 4/1972 | Winsor et al. | 208/89 |
| 3,717,571 | 2/1973 | B.L. Shulman | 208/254 |
| 3,728,250 | 4/1973 | Hass et al. | 208/89 |
| 3,970,543 | 7/1976 | H.A. McIntosh | 208/86 |
| 4,469,590 | 9/1984 | Schucker et al. | 208/143 |
| 5,110,444 | 5/1992 | Haun et al. | 208/89 |
| 5,114,562 | 5/1992 | Haun et al. | 208/89 |

FOREIGN PATENT DOCUMENTS 441195 8/1991 European Pat. Off. .

*Primary Examiner*—Walter D. Griffin

*Attorney, Agent, or Firm*—Ostrolenk,Faber,Gerb & Soffen,LLP

[57] ABSTRACT

There is provided a method of manufacturing gas oil containing low-sulfur and low-aromatic-compound content, said method including a first step of putting distilled petroleum to contact with hydrogen gas in the presence of a hydrotreating catalyst to reduce the sulfur concentration to not higher than 0.05 wt % and a second step of reducing the aromatic compound concentration in the presence of a noble metal type catalyst, with at least a pair of high temperature high pressure gas liquid separators arranged between the two steps to separate the gaseous and liquid components of distilled petroleum and hydrogen gas or hydrogen containing gas is introduced into the liquid component in each of the separators.

16 Claims, No Drawings

METHOD OF MANUFACTURING GAS OIL CONTAINING LOW AMOUNTS OF SULFUR AND AROMATIC COMPOUNDS

BACKGROUND OF THE INVENTION

1. Field of the Invention

This invention relates to a method of manufacturing gas oil containing low-sulfur and low-aromatic-compounds and, more particularly, it relates to a method of manufacturing gas oil containing low-sulfur and low-aromatic-compounds from distilled petroleum.

2. Background Art

Currently in Japan, gas oil for diesel engines is typically prepared by mixing a desulfurized gas oil fraction obtained by treating straight-run gas oil in an ordinary desulfurizer, a straight-run gas oil fraction, a straight-run kerosene fraction and a gas oil fraction obtained from a cracking facility and normally contains sulfur by 0.1 to 0.2% by weight. However, the prevalent environmental view in that country requires a further reduction in the concentration of NOx and particulate substances in the diesel engine exhaust gas and it is stipulated by law that the sulfur concentration in gas oil has to be reduced from the current level of 0.2 wt % to as low as 0.05 wt %.

Additionally, it is a popularly accepted theory that aromatic compounds contained in gas oil can give rise to NOx and particulate substances in the diesel engine exhaust gas as they lower the octane value of gas oil, making a reduction in the concentration of aromatic compounds an urgent problem to be solved. In particular, in view of the fact that cracked gas oil that is drawn out of fluid catalytic cracking facilities and expected to see an ever increasing demand as a basic component of gas oil contains aromatic compounds in a large concentration, any attempt to reduce the aromatic-compound concentration in gas oil should be very significant.

A noble metal type catalyst that can actively hydrogenate aromatic compounds is preferably used for manufacturing gas oil containing a low amount of aromatic compounds. However, since a noble metal type catalyst can be severely poisoned by sulfur compounds and hydrogen sulfide, the oil has to be sufficiently desulfurized and hydrogen sulfide produced by the process of desulfurization has to be removed satisfactorily before reducing the concentration of aromatic compounds by means of a noble metal type catalyst.

Thus, the current process of manufacturing gas oil containing low-sulfur and low-aromatic-compounds proceeds as follows. In the first step of operation, feedstock oil is put into contact with a hydrotreating catalyst in the presence of hydrogen for desulfurization at high temperature and under high pressure. Then, the product is cooled and the gaseous component is separated from the liquid component to remove any gaseous component before the hydrogen sulfide dissolved in the liquid component is stripped off under atmospheric pressure. Thereafter, the obtained oil that contains sulfur compounds to a reduced concentration is put to contact with a noble metal type catalyst to reduce the concentration of aromatic compounds while raising the pressure again and heating the oil with hydrogen gas to a predetermined temperature by means of a heat exchanger (AIChE 1993 Spring National Meeting Preprint, (70e), 5). However, this process requires complicated equipment and is commercially not feasible because of the large plant and equipment investment and a high running cost.

SUMMARY OF THE INVENTION

It is therefore the object of the invention to provide a method of manufacturing gas oil with a sulfur concentration of not higher than 0.05 wt % and a reduced concentration of aromatic compounds from sulfur containing distilled petroleum.

As a result of intensive research efforts, the inventors of the invention have found that gas oil containing low-sulfur and low-aromatic-compound can be produced from distilled petroleum by means of a two-step hydrotreating process that is conducted under specific conditions.

Thus, according to the present invention, the above object is achieved by providing a method of manufacturing gas oil containing low-sulfur and low-aromatic-compounds said method comprising a first step of putting distilled petroleum into contact with hydrogen gas in the presence of a hydrotreating catalyst to reduce the sulfur concentration to not higher than 0.05 wt % and a second step of reducing the aromatic compound concentration in the presence of a noble metal type catalyst, characterized in that at least a pair of high temperature high pressure gas liquid separators are arranged between the two steps to separate the gaseous and liquid components of distilled petroleum and hydrogen gas or hydrogen containing gas is introduced into the liquid component in each of the separators.

For the purpose of the present invention, distilled petroleum preferably contains sulfur and sulfur compounds to a concentration between 0.1 and 2.0 wt % and has a boiling point between 150° and 400° C. For the purpose of the present invention, distilled petroleum may be distilled oil obtained by distilling crude oil under atmospheric or reduced pressure or by distilling an oil product of fluid catalytic cracking (FCC) or thermal cracking. Any of these different distilled petroleums may be used independently or as a mixture.

For the purpose of the present invention, distilled petroleum is preferably a mixture of distilled oil obtained by distilling an oil product of fluid catalytic cracking (FCC) or thermal cracking and distilled oil obtained by distilling crude oil under atmospheric or reduced pressure. The ratio at which the distilled oil obtained by distilling an oil product of fluid catalytic cracking (FCC) or thermal cracking and the distilled oil obtained by distilling crude oil under atmospheric or reduced pressure are mixed is between 1:99 and 99:1 and preferably between 10:90 and 50:50.

For the purpose of the present invention, desulfurization of distilled petroleum mainly takes place in the first step and the concentration of aromatic compounds is reduced in the second step. The operation of separating the gas and liquid components is repeated at least twice between the first step and the second step, and hydrogen gas or hydrogen containing gas is introduced into the separated liquid in order to reduce the concentration of hydrogen sulfide gas dissolved in the liquid.

The hydrotreating operation of the first step is conducted at temperature between 300° and 450° C., preferably between 330° and 400° C., when measured at the outlet of the catalyst layer.

The hydrotreating operation of the first step is conducted under hydrogen partial pressure of between 30 and 150 $kg/cm^2$, preferably between 50 and 100 $kg/cm^2$.

In the first step, distilled petroleum is preferably fed at a rate (liquid hourly space velocity-LHSV) of between 0.1 and 10 $h^{-1}$, more preferably between 0.5 and 6 $h^{-1}$. In the first step, hydrogen gas is preferably fed at a rate of between 200 and 5,000 scf/bbl, more preferably between 500 and 2,000 scf/bbl, in terms of hydrogen gas/oil ratio.

The hydrotreating catalyst of the first step may be a catalyst normally used for ordinary hydrotreatment of distilled petroleum and realized by using a porous inorganic oxide carrier carrying a hydrogenation active metal. For the purpose of the present invention, materials that can be used for a porous inorganic oxide carrier include alumina, titania, boria, zirconia, silica-alumina, silica-magnesia, alumina-magnesia, alumina-titania, silica-titania, alumina-boria and alumina-zirconia. The use of alumina or silica-alumina is particularly preferable.

Hydrogenation active metals include chromium, molybdenum, tungsten, cobalt and nickel. Any of these metals may be used independently or as a mixture. The use of a mixture of cobalt-molybdenum, nickel-molybdenum or nickel-cobalt is particularly preferable. Any of these metals can lie on the carrier in the form of metal, oxide, sulfide or a mixture thereof. For the purpose of the present invention, a catalyst realized by using an alumina carrier of carrying thereon active metals of cobalt-molybdenum, nickel-molybdenum or nickel-cobalt is preferably used in the first step.

Any known technique such as impregnation and coprecipitation may be used to make a carrier carry one or more than one active metals. The rate at which the carrier carries one or more than one active metals is between 1 and 30 wt %, more preferably between 3 and 20 wt %, in terms of their respective oxides.

The catalyst may take any form such as that of particulates, tablets, cylindrical columns, trefoils or quatrefoils. The hydrotreating catalyst of the first step may preferably be sulfurized in advance before it is actually put to use.

The hydrotreating reaction column to be used for the first step may be of a fixed bed type, a fluid bed type or an expansive bed type, although a fixed bed type is particularly preferable.

The mode of contact of hydrogen and distilled petroleum in the first step may be that of parallel rising flow, parallel falling flow or counterflow.

For the purpose of the present invention, distilled petroleum is desulfurized in the first step until the sulfur concentration is reduced to not higher than 0.05 wt %.

For the purpose of the present invention, at least a pair of high temperature high pressure gas liquid separators are arranged between the first step and the second step. These separators are connected in series.

A mixture of gas and liquid coming from the first step is fed to the first high temperature high pressure gas liquid separator to separate the mixture into gas and liquid. After introducing hydrogen gas or hydrogen containing gas into the liquid, the latter is fed to the second high temperature high pressure gas liquid separator to separate it further into gas and liquid. Then, hydrogen gas or hydrogen containing gas is introduced again into the obtained liquid before it is fed to the second step of hydrogenation. By repeating at least twice the operation of introducing hydrogen gas or hydrogen containing gas into the liquid produced by the gas/liquid separation process, the hydrogen sulfide concentration in the liquid can be significantly reduced.

All the high temperature high pressure gas liquid separators arranged between the first and second steps are operated for gas/liquid separation at temperature of between 200° and 450° C., preferably between 220° and 400° C., and under pressure of between 30 and 150 kg/cm$^2$, preferably between 50 and 100 kg/cm$^2$.

For the purpose of the present invention, hydrogen gas needs to be pure hydrogen gas, whereas hydrogen containing gas contains hydrogen preferably by not lower than 50 vol %, more preferably not lower than 60 vol %. Hydrogen containing gas is a mixture of a gaseous product of a reaction tower and unreacted hydrogen gas and contains as principal ingredients hydrogen gas, hydrocarbon gas, inert gas and hydrogen sulfide gas. If the gaseous mixture is recirculated for use, the concentration of hydrogen sulfide gas has to be reduced to a predetermined level by treating with amine compounds, or the like.

Preferably pure hydrogen gas is introduced into the liquid produced by the high temperature high pressure gas liquid separators arranged between the first and second steps. If hydrogen containing gas is used instead, the concentration of hydrogen sulfide gas in it is preferably not higher than 2,000 volppm, more preferably not higher than 1,000 volppm. When hydrogen containing gas is introduced into the liquid produced by the last high temperature high pressure gas liquid separator, the concentration of hydrogen sulfide gas in it is preferably not higher than 500 volppm.

The rate at which hydrogen containing gas is introduced into the liquid produced by the high temperature high pressure gas liquid separators is preferably between 200 and 5,000 scf/bbl, more preferably between 500 and 3,000 scf/bbl, in terms of hydrogen/oil ratio.

Since gas and liquid are separated in gas liquid separators at high temperature, a method according to the present invention can provide a separation efficiency much higher than that of a comparable method that carries out the gas/liquid separating operation at low temperature. Additionally, since hydrogen gas or hydrogen containing gas is introduced at least twice into the liquid product, the concentration of hydrogen sulfide contained in the liquid product is dramatically reduced. Thus, a noble metal type catalyst that can be severely poisoned by sulfur compounds can be used in the second step. Still additionally, with a method according to the present invention, the equipment for reducing the concentration of hydrogen sulfide can be operated without reducing the temperature and the pressure to ambient temperature and the atmospheric pressure, respectively.

In the second step, the concentration of aromatic compounds in gas oil is reduced by hydrogenation.

The hydrogenating operation of this second step is conducted at temperature between 200° and 400° C., preferably between 220° and 350° C., when measured at the outlet of the catalyst layer.

The hydrogenating operation of this second step is conducted under pressure between 30 and 150 kg/cm$^2$, preferably between 50 and 100 kg/cm$^2$in terms of the partial pressure of hydrogen.

In the second step, distilled petroleum is preferably fed at a rate (liquid hourly space velocity-LHSV) of between 0.5 and 10 h$^{-1}$, more preferably between 1 and 9 h$^{-1}$.

In the second step, hydrogen gas is preferably fed at a rate of between 200 and 5,000 scf/bbl, more preferably between 500 and 3,000 scf/bbl.

The hydrogenating catalyst of the second step may be a noble metal type catalyst carried on a carrier. For the purpose of the present invention, the noble metal is selected from ruthenium, rhodium, palladium, iridium, osmium, platinum and a mixture thereof, of which ruthenium, palladium and platinum are preferable because of their high hydrogenation potential.

For the purpose of the present invention, materials that can be used for a carrier include zeolites, clay compounds, sedimentary compounds, porous inorganic oxides and a mixture thereof, of which zeolites and clay compounds are preferably used because of their high sulfur resistance properties.

Further, into the catalyst any additives can be added. The preferable ones are boron, phosphorus, vanadium, molybdenum, manganese, nickel, cobalt, iron, copper, tantalum, niobium, silver, tungsten, rhenium, gold, rare earth metals, and their derivatives.

The carrier can be made to carry any of the active metal by means of a known technique such as impregnation, coprecipitation or ion exchange. The rate at which the carrier carries the selected active metal is between 0.1 and 10 wt %, more preferably between 0.5 and 3 wt %.

The catalyst of the second step may take any form such as that of particulates, tablets, cylindrical columns, trefoils or quatrefoils.

The hydrogenating catalyst of the second step may preferably be treated for hydrogenation in advance before it is actually put to use.

The hydrogenation reaction column to be used for the second step may be of a fixed bed type, a fluid bed type or an expansive bed type, although a fixed bed type is particularly preferable.

The mode of contact of hydrogen and distilled petroleum in the second step may be that of parallel rising flow, parallel falling flow or counterflow.

DETAILED DESCRIPTION OF THE PREFERRED EMBODIMENTS

Now, the present invention will be described further by way of examples, although it is not limited by the examples in any means.

(EXAMPLE 1)

As distilled petroleum, a mixture oil containing 80% atmospheric straight distillation gas oil and 20% light cycle oil (LCO) obtained from a fluid catalytic cracking (FCC) was used and subjected to a two-step hydrogenation process under the conditions listed in Table 1. A pair of high temperature high pressure gas liquid separators were arranged between the first and second steps and hydrogen gas was introduced into the separated liquid products of the separating operations using the separators. The operating conditions of the high temperature high pressure gas liquid separators are also listed in Table 1. The sulfur concentration of the mixture oil was 0.98 wt % and the concentration of aromatic compounds was 39% when tested with FIA. A commercially available hydrotreating catalyst comprising an aluminum carrier carrying a 5 wt % of CoO and a 15 wt % of $MoO_3$ was used for the first step. The catalyst was sulfurized in advance before it was actually put to use by a conventional method. The hydrogenating catalyst of the second step was prepared by using acidic Y-type zeolite powder containing $SiO_2$ and $Al_2O_3$ to a content ratio of 20, impregnating it with a mixed solution of platinum chloride and palladium chloride to cause it to carry the noble metals, drying and thereafter baking at 300° C. for three (3) hours. The noble metal content of the catalyst was 0.8 wt %. Some of the chemical properties of the output oil of the first step and that of the second step are also listed in Table 1. Note that the concentrations of aromatic compounds in Table 1 are those of gas oil when tested with FIA.

(Comparative Example 1)

The distilled petroleum and the catalysts as well as the test conditions of this example were same as their counterparts of Example 1, except that only one high temperature high pressure gas liquid separator was used. The obtained results are also shown in Table 1.

(Comparative Example 2)

The distilled petroleum and the catalysts as well as the test conditions of this example were same as their counterparts of Example 1, except that no high temperature high pressure gas liquid separator was used. In other words, the product of the first step was directly fed to the second step. The obtained results are also shown in Table 1.

TABLE 1

| | Example 1 | Comparative Example 1 | Comparative Example 2 |
|---|---|---|---|
| <Conditions for 1st Step> | | | |
| Reaction Pressure ($kg/cm_2$) | 55 | 55 | 55 |
| Reaction Temperature (°C.) | 369 | 369 | 369 |
| LHSV ($h^{-1}$) | 4.5 | 4.5 | 4.5 |
| Hydrogen/Oil Ratio (scf/bbl) | 1500 | 1500 | 1500 |
| <Properties of 1st Step Oil Product> | | | |
| Sulfur Content (wt %) | 0.033 | 0.033 | 0.033 |
| Aromatic Compounds (%) | 36 | 36 | 36 |
| <Gas Liquid Separation/Gas Mixing Step> | | | |
| No.1 | | | |
| Pressure ($kg/cm_2$) | 55 | 55 | — |
| Temperature (°C.) | 369 | 369 | — |
| Hydrogen Introduction Rate | 1500 | 1500 | — |
| Hydrogen/Oil Rate (scf/bbl) | | | |
| No.2 | | | |
| Pressure ($kg/cm_2$) | 55 | — | — |
| Temperature (°C.) | 369 | — | — |
| Hydrogen Introduction Rate | 1500 | — | — |
| Hydrogen/Oil Rate (scf/bbl) | | | |
| <Conditions for 2nd Step> | | | |
| Reaction Pressure ($kg/cm_2$) | 55 | 55 | 55 |
| Reaction Temperature (°C.) | 300 | 300 | 300 |
| LHSV ($h^{-1}$) | 1.5 | 1.5 | 1.5 |
| Hydrogen/Oil Ratio (scf/bbl) | 1500 | 1500 | — |
| <Properties of 2nd Step Oil Product> | | | |
| Sulfur Content (wt %) | 0.030 | 0.031 | 0.033 |
| Aromatic Compounds (%) | 17 | 24 | 34 |

(EXAMPLE 2)

The distilled petroleum and the catalysts of this example were same as their counterparts of Example 1 but the test conditions as listed in Table 2 were used. The obtained results are shown in Table 2. Note that the concentrations of aromatic compounds in Table 2 are those of gas oil when tested with FIA.

(Comparative Example 3)

The distilled petroleum and the catalysts of this example were same as their counterparts of Example 1 except that only one high temperature high pressure gas liquid separator was used. The test conditions as listed in Table 2 were used. The obtained results are also shown in Table 2.

(Comparative Example 4)

The distilled petroleum and the catalysts of this example were same as their counterparts of Example 1 except that no high temperature high pressure gas liquid separator was used. The test conditions as listed in Table 2 were used. In other words, the product of the first step was directly fed to the second step. The obtained results are also shown in Table 2.

TABLE 2

| | Example 2 | Comparative Example 3 | Comparative Example 4 |
|---|---|---|---|
| <Conditions for 1st Step> | | | |
| Reaction Pressure (kg/cm$^2$) | 65 | 65 | 65 |
| Reaction Temperature (°C.) | 369 | 369 | 369 |
| LHSV (h$^{-1}$) | 4.5 | 4.5 | 4.5 |
| Hydrogen/Oil Ratio (scf/bbl) | 2500 | 2500 | 2500 |
| <Properties of 1st Step Oil Product> | | | |
| Sulfur Content (wt %) | 0.010 | 0.010 | 0.010 |
| Aromatic Compounds (%) | 35 | 35 | 35 |
| <Gas Liquid Separation/Gas Mixing Step> | | | |
| No.1 | | | |
| Pressure (kg/cm$^2$) | 65 | 65 | — |
| Temperature (°C.) | 369 | 369 | — |
| Hydrogen Introduction Rate Hydrogen/Oil Rate (scf/bbl) | 2500 | 2500 | — |
| No.2 | | | |
| Pressure (kg/cm$^2$) | 65 | — | — |
| Temperature (°C.) | 369 | — | — |
| Hydrogen Introduction Rate Hydrogen/Oil Rate (scf/bbl) | 2500 | — | — |
| <Conditions for 2nd Step> | | | |
| Reaction Pressure (kg/cm$^2$) | 65 | 65 | 65 |
| Reaction Temperature (°C.) | 320 | 320 | 320 |
| LHSV (h$^{-1}$) | 1.5 | 1.5 | 1.5 |
| Hydrogen/Oil Ratio (scf/bbl) | 2500 | 2500 | — |
| <Properties of 2nd Step Oil Product> | | | |
| Sulfur Content (wt %) | 0.009 | 0.009 | 0.009 |
| Aromatic Compounds (%) | 9 | 17 | 30 |

As seen from the above examples and comparative examples, a hydrotreating method according to the invention is very effective to produce gas oil containing low-sulfur and low-aromatic-compounds.

Since at least a pair of high temperature high pressure gas liquid separators are installed between the first and second steps and hydrogen gas or hydrogen containing gas is introduced into the liquid product of the gas liquid separators to reduce the concentration of hydrogen sulfide contained in the liquid product, one or more than one noble metal type catalysts can be used in the second step to reduce the concentration of aromatic compounds in the produced gas oil.

What is claimed is:

1. A method of manufacturing gas oil containing low amounts of sulfur and aromatic compounds, comprising contacting distilled petroleum with hydrogen gas in the presence of at least one hydrotreating catalyst to reduce the sulfur concentration to not higher than 0.05 weight percent, introducing the hydrotreated petroleum into a first high temperature high pressure gas liquid separator to thereby separate the hydrotreated distilled petroleum into gaseous and liquid components and introducing hydrogen into the liquid component, introducing the hydrogen treated liquid into a second high temperature high pressure gas liquid separator to thereby separate the material into gaseous and liquid components and introducing hydrogen into the liquid component, and contacting the resultant liquid component with at least one noble metal hydrogenation catalyst to reduce the aromatic compound concentration thereof.

2. A method according to claim 1, wherein distilled petroleum is a mixture of (a) at least one of a distilled oil product of fluid catalytic cracking (FCC) or of thermal cracking and (b) crude oil distilled under atmospheric or reduced pressure.

3. A method according to claim 1, wherein the gas liquid separators are at a temperature between 200° and 450° C. and under a pressure between 30 and 150 kg/cm$^2$.

4. A method according to claim 3, wherein the gas liquid separators are at a temperature between 220° and 400° C., and under a pressure between 50 and 100 kg/cm$^2$.

5. A method according to claim 4, wherein the hydrogen is introduced into the liquid component in the separators at a flow rate of 500 to 3000 scf/bbl.

6. A method according to claim 5, wherein distilled petroleum is a mixture of (a) at least one of a distilled oil product of fluid catalytic cracking (FCC) or of thermal cracking and (b) crude oil distilled under atmospheric or reduced pressure.

7. A method according to claim 6, wherein the distilled petroleum has a boiling point of 150° to 400° C. and a sulfur content of 0.1 to 2 weight percent; the contact with the hydrotreating catalyst is at a temperature between 300° and 450° C., a hydrogen partial pressure between 30 and 150 kg/cm$^2$, a liquid hourly space velocity between 0.1 and 10 h$^{-1}$, a hydrogen feed rate of between 200 and 5,000 scf/bbl and said hydrotreating catalyst is 1 to 30 weight percent cobalt-molybdenum, nickel-molybdenum or nickel-cobalt on alumina or silica-alumina; and the contact with the noble metal hydrogenation catalyst is at between 200° and 400° C., a liquid hourly space velocity between 0.5 and 10 h$^{-1}$, a hydrogen partial pressure of between 30 and 150 kg/cm$^2$, a hydrogen flow rate between 200 and 5,000 scf/bbl, and the noble metal hydrogenation catalyst is at between 0.1 and 10 weight percent of at least one member of the groups consisting of ruthenium, palladium and platinum on a zeolite or clay carrier.

8. A method according to claim 7, wherein the contact with the hydrotreating catalyst is at a temperature between 330° and 400° C., a hydrogen partial pressure between 50 and 100 kg/cm$^2$, a liquid hourly space velocity between 0.5 and 6 h$^{-1}$, a hydrogen feed rate of between 500 and 2,000 scf/bbl and said hydrotreating catalyst is 3 to 20 weight percent cobalt-molybdenum, nickel-molybdenum or nickel-cobalt on alumina or silica-alumina; and the contact with the noble metal hydrogenation catalyst is at between 220° and 350° C., a liquid hourly space velocity between 1 and 9 h$^{-1}$, a hydrogen partial pressure of between 50 and 100 kg/cm$^2$, a hydrogen flow rate between 500 and 3,000 scf/bbl, and the noble metal hydrogenation catalyst is at between 0.5 and 3 weight percent of at least one member of the groups consisting of rhenium, palladium and platinum on a zeolite or clay carrier.

9. A method according to claim 1, wherein the hydrotreated petroleum is not subjected to a cooling step between contact with the hydrotreatment catalyst and the first high temperature high pressure gas liquid separator.

10. A method according to claim 9, wherein the gas liquid separators are at a temperature between 200° and 450° C. and under a pressure between 30 and 150 kg/cm$^2$.

11. A method according to claim 10, wherein the gas liquid separators are at a temperature between 220° and 400° C., and under a pressure between 50 and 100 kg/cm$^2$.

12. A method according to claim 11, wherein the hydrogen is introduced into the liquid component in the separators at a flow rate of 500 to 3000 scf/bbl.

13. A method according to claim 12, wherein distilled petroleum is a mixture of (a) at least one of a distilled oil product of fluid catalytic cracking (FCC) or of thermal cracking and (b) crude oil distilled under atmospheric or reduced pressure.

14. A method according to claim 13, wherein the distilled petroleum has a boiling point of 150° to 400° C. and a sulfur content of 0.1 to 2 weight percent; the contact with the hydrotreating catalyst is at a temperature between 300° and 450° C., a hydrogen partial pressure between 30 and 150 $kg/cm^2$, a liquid hourly space velocity between 0.1 and 10 $h^{-1}$, a hydrogen feed rate of between 200 and 5,000 scf/bbl and said hydrotreating catalyst is 1 to 30 weight percent cobalt-molybdenum, nickel-molybdenum or nickel-cobalt on alumina or silica-alumina; and the contact with the noble metal hydrogenation catalyst is at between 200° and 400° C. a liquid hourly space velocity between 0.5 and 10 $h^{-1}$, a hydrogen partial pressure of between 30 and 150 $kg/cm^2$, a hydrogen flow rate between 200 and 5,000 scf/bbl, and the noble metal hydrogenation catalyst is at between 0.1 and 10 weight percent of at least one member of the groups consisting of ruthenium, palladium and platinum on a zeolite or clay carrier.

15. A method according to claim 14, wherein the contact with the hydrotreating catalyst is at a temperature between 330° and 400° C., a hydrogen partial pressure between 50 and 100 $kg/cm^2$, a liquid hourly space velocity between 0.5 and 6 $h^{-1}$, a hydrogen feed rate of between 500 and 2,000 scf/bbl and said hydrotreating catalyst is 3 to 20 weight percent cobalt-molybdenum, nickel-molybdenum or nickel-cobalt on alumina or silica-alumina; and the contact with the noble metal hydrogenation catalyst is at between 220° and 350° C., a liquid hourly space velocity between 1 and 9 $h^{-1}$, a hydrogen partial pressure of between 50 and 100 $kg/cm^2$, a hydrogen flow rate between 500 and 3,000 scf/bbl, and the noble metal hydrogenation catalyst is at between 0.5 and 3 weight percent of at least one member of the groups consisting of rhenium, palladium and platinum on a zeolite or clay carrier.

16. A method according to claim 1, wherein at least one the of the hydrogen contacting steps employs the hydrogen in the form of a hydrogen containing gas.

* * * * *